United States Patent [19]

Takagi et al.

[11] Patent Number: 4,658,111

[45] Date of Patent: Apr. 14, 1987

[54] METHOD FOR HARDENING A SURFACE OF A CAM PROVIDED ON A CAMSHAFT

[75] Inventors: Soya Takagi; Toshiharu Fukuizumi, both of Toyota, Japan

[73] Assignee: Toyota Jidosha Kabushiki Kaisha, Aichi, Japan

[21] Appl. No.: 782,001

[22] Filed: Sep. 30, 1985

Related U.S. Application Data

[63] Continuation-in-part of Ser. No. 643,011, Aug. 22, 1984, abandoned.

[30] Foreign Application Priority Data

Aug. 31, 1983 [JP] Japan ..... 58-159766

[51] Int. Cl.[4] ..... B23K 9/12

[52] U.S. Cl. ..... 219/125.1; 219/125.12; 219/76.15; 74/53; 74/55; 74/57

[58] Field of Search ..... 219/125.1, 125.12, 76.15; 74/53, 55, 37

[56] References Cited

U.S. PATENT DOCUMENTS

| | | | |
|---|---|---|---|
| 363,007 | 5/1887 | Shanks et al. | 74/53 |
| 2,017,003 | 10/1935 | Hume | 219/125.1 |
| 3,059,482 | 10/1962 | Petzoldt | 74/53 |
| 3,185,814 | 5/1965 | Rossner et al. . | |
| 3,392,262 | 7/1968 | Hansen et al. . | |
| 3,585,837 | 6/1971 | Bihler | 74/53 |
| 4,229,642 | 10/1980 | Sakurai et al. . | |

FOREIGN PATENT DOCUMENTS 2839990 8/1979 Fed. Rep. of Germany .

*Primary Examiner*—E. A. Goldberg
*Assistant Examiner*—Lincoln D. Donovan
*Attorney, Agent, or Firm*—Parkhurst & Oliff

[57] ABSTRACT

A method and apparatus are provided for hardening a surface of a cam which forms a chill layer of equal depth on the surface of the cam. The method includes the steps of rotating a cylinder cam and thereby oscillating a holder, rotating a camshaft on which the cam whose surface is to be hardened is located and emitting the high energy toward the surface to be hardened. The cylinder cam which is rotated includes a guide groove which includes at least two straight grooves and at least two 'V' shape connecting portions so that 'V' shape connecting portions connect the straight grooves and form a continuous peripheral guide groove on a surface of the cylinder cam. The holder which holds the camshaft is oscillated at a constant speed in the axial direction of the camshaft by the rotation of the cylinder cam. The camshaft is rotated in the circumferential direction of the camshaft concurrently with the oscillation of the holder. A torch is provided to emit the high energy to the surface of the cam concurrently with the oscillation of the holder and the rotation of the camshaft.

10 Claims, 14 Drawing Figures

METHOD FOR HARDENING A SURFACE OF A CAM PROVIDED ON A CAMSHAFT

BACKGROUND OF THE INVENTION

This is a continuation-in-part Application of Patent Application Ser. No. 643,011, filed on Aug. 22, 1984, now abandoned/ .

The present invention relates to a method for hardening a surface of a cam provided on a camshaft which is to be installed in an engine, and more particularly to a method for hardening a surface of a cam to form a chill structure thereon.

A conventional surface hardening method is disclosed in Auslegeschrift No. 28 39 990. In this conventional surface hardening method, a cam surface of a camshaft made of cast iron is melted by a high amount of energy emitted from a torch, and a chill layer is formed on the surface of the camshaft. The camshaft is moved in the axial direction of the camshaft by an eccentric cam mechanism. Accordingly, the high energy emitted forms a trail in a zig-zag pattern on the cam surface of the camshaft. The zig-zag is in the shape of a sine curve as shown in FIG. 3 of Auslegeschrift No. 28 39 990 and FIG. 13 of this application. Further, when the camshaft is moved in the axial direction by the eccentric cam, the camshaft does not move at a constant speed. As a result, when the energy is emitted from a torch to the cam surface during the axial movement of the camshaft, a central portion of the cam surface in the axial direction receives a relatively small amount of light high energy, because the central portion of the cam surface moves at a relatively higher speed below the torch than the peripheral portions of the cam surface. Accordingly, this conventional surface hardening method does not form a chill layer 142 of equal depth on the cam surface, as shown in FIG. 14 of this application.

In order to obtain a chill layer of equal depth by the eccentric cam mechanism, it is necessary to move the camshaft at a very high speed. As a result of the high speed, a chill layer of constant depth is obtained on the cam surface but the depth is extremely low.

Further, when the torch moves at a slow speed, a deep chill layer is obtained at the central portion of the cam surface, but the depth of the chill layer at both ends in the lateral direction of the cam surface becomes extreme, and the ends of the cam surface are melted down.

SUMMARY OF THE INVENTION

The present invention was made in view of the foregoing background and to overcome the foregoing drawbacks. It is accordingly an object of this invention to provide a method for hardening a surface of a cam provided on a camshaft to obtain a chill layer of constant depth on the surface of the cam along the axial direction of the camshaft.

To attain the above objects, a method and apparatus for hardening the surface of the cam includes the steps of first rotating a cylinder cam which oscillates a holder, second rotating a camshaft and third emitting the high energy. In the first rotating step, the cylinder cam includes a guide groove which comprises at least two straight grooves and at least two 'V' shape connecting portions, so that the 'V' shape connecting portions connect the two straight grooves and form a continuous guide groove on a surface of the cylinder cam. In the oscillating step, the holder which holds the camshaft is oscillated at a constant speed in the axial direction of the camshaft by a means for transmitting the rotation of the cylinder cam to the holder. In the second rotating step, the camshaft is rotated in the circumferential direction of the camshaft concurrent with the oscillation of the holder. In the emitting step, a torch emits the high energy to the surface of the cam concurrent with the oscillation of the holder and the rotation of the camshaft.

As a result, the camshaft oscillates at a constant speed in the axial direction of the camshaft, while the camshaft rotates in the circumferential direction of the cam during the emitting step. Thus, a chill layer of constant depth in the axial direction of the camshaft is formed on the surface of the cam.

BRIEF DESCRIPTION OF THE DRAWINGS

The above objects, features and advantages of the present invention will become more apparent from the following description of the preferred embodiments taken in conjunction with the accompanying drawings, wherein.

DETAILED DESCRIPTION OF THE PREFERRED EMBODIMENTS

The present invention is described in detail with reference to the accompanying drawings which illustrate different embodiments of the present invention.

Figure 1:
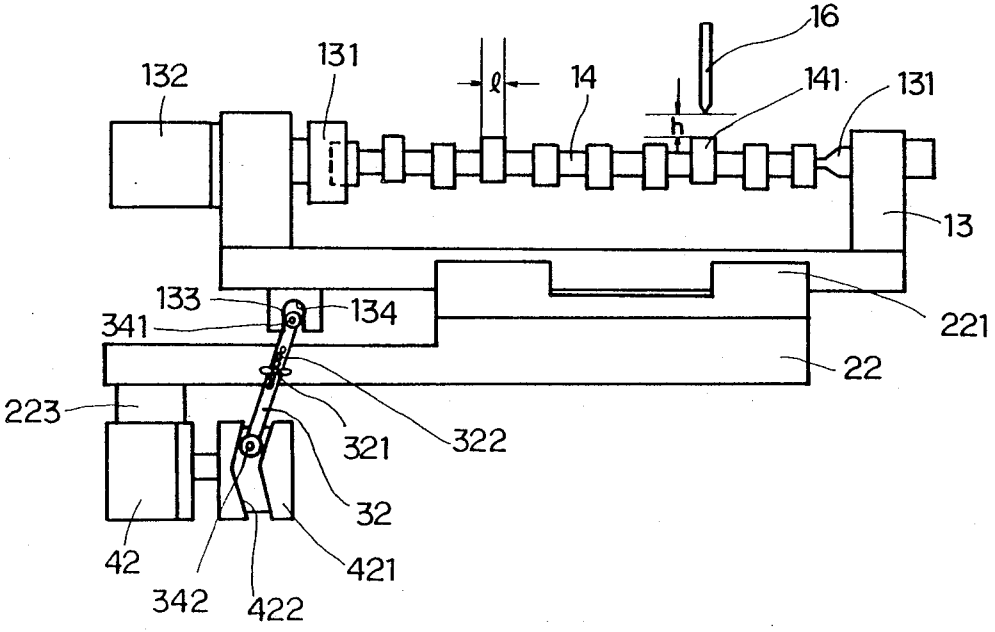
FIG. 1 is a side view of a first embodiment of the present invention.
Figure 2:
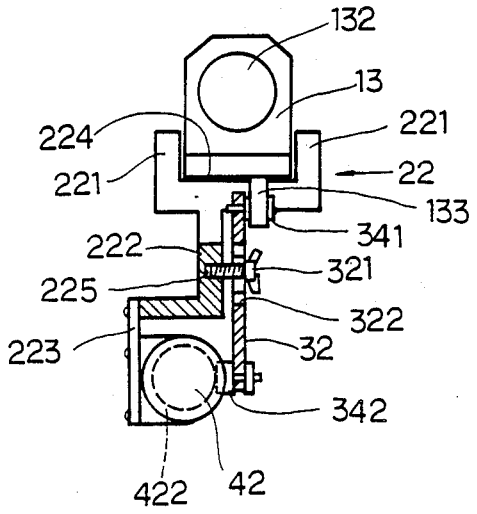
FIG. 2 is a front view of the first embodiment of the present invention as viewed from the left-hand side of FIG. 1, including a partial cross-sectional view.

Referring to FIG. 1, a camshaft 14 is mounted rotatably on a holder 13. The camshaft 14 includes a plurality of cams 141 thereon. The holder 13 includes a pair of locating devices 131 which can be in contact with both ends of the camshaft 14 and which secure the camshaft 14 to the holder 13. The camshaft 14 can be rotated by a motor 132 which is mounted on the holder 13. Each of a plurality of torches 16 is moved radially (e.g., toward and away from the axis of the camshaft) in relation to the camshaft 14 and located over each of the plurality of cams 141 with a constant interval 'h' defined between a cam surface of the cam 141 and an emitting nozzle of the torch 16. It is normally not desirable to move the torches 16 circumferenctially (e.g., rotationally around the axis of the shaft) or axially (e.g., in the longitudinal direction of the axis of the camshaft 14) in relation to the camshaft 14. The holder 13 further includes a guide portion 133 which is located on a lower surface of the holder 13 and a vertical guiding groove 134 which is formed in the guide portion 133. As shown in FIG. 2, a base member 22 is located under the holder 13 and the base member 22 includes a plurality of supporting flanges 221, a guiding surface 224, a base portion 222 and a mounting flange 223. The plurality of supporting flanges 221 are located on both sides of the holder 13 and the lower surface of the holder 13 is in contact with the guiding surface 224 of the base member 22. The base portion 222 includes a hole 225 in which a screw 321 is inserted. The screw 321 penetrates one of a plurality of adjusting apertures 322 of a rod 32. The rod 32 includes a first roller 341 which is mounted rotatably on an end of the rod 32 and is located slidably within the guiding groove 134 of the guide portion 133 and a second roller 342 which is mounted on the other end of the rod 32. Another motor 42 is mounted on the mounting flange 223 of the base member 22, and the motor 42 rotates a cylinder cam 421. The cylinder cam 421 includes a peripheral guide groove 422 and the second roller 342 is located slidably within the peripheral guide groove 422.

Figure 3:
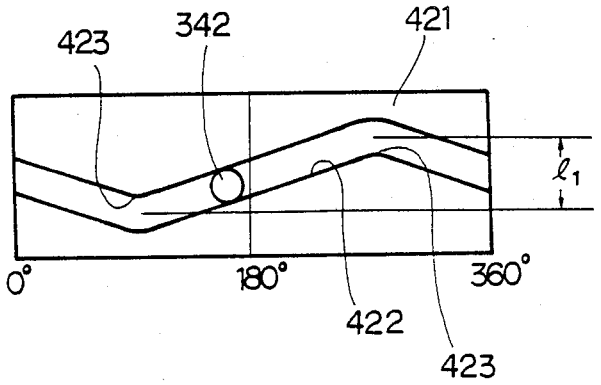
FIG. 3 is an enlarged view of a peripheral surface of a cam employed in the first embodiment.

As shown in FIG. 3, the peripheral guide groove 422 includes two straight grooves which are inclined from the vertical direction in FIG. 1. The two straight grooves are connected to each other by a pair of V shape portions 423 of the peripheral guide groove 422. Accordingly, when the cylinder cam 421 is rotated by the motor 42, the second roller 342 moves horizontally in FIG. 1 by the peripheral guide groove 422 of the cylinder cam 421. Then, the rod 32 rotates about the screw 321 and the first roller 341 moves in horizontal direction in FIG. 1. Therefore, the holder 13 moves horizontally along the guiding surface 224 of the base member 22.

The width of the movement of the holder 13 is the same as the horizontal length '$l_1$' defined between two central points of the pair of V shape portions 423 of the peripheral guide groove 422. A width 'l' of the cam 141 is defined as being equal to or smaller than the horizontal length '$l_1$' of the peripheral guide groove 422.

The horizontal length of the movement of the holder 13 can be changed by an adjustment of the screw 321 which is inserted into one of the adjusting apertures 322, e.g., when the screw 321 is inserted into the highest one of the adjusting apertures 322 and the hole 225, the horizontal length of the movement of the holder 13 becomes smaller than the horizontal length '$l_1$' of the peripheral guide groove 422, and when the screw 321 is inserted into the lower one of the adjusting apertures 322 and the hole 225, the horizontal length of the movement of the holder 13 becomes equal to the horizontal length '$l_1$' of the peripheral guide groove 422.

Figure 4:
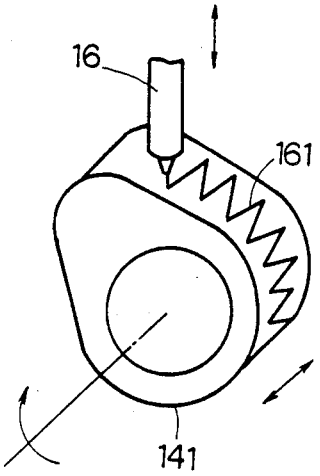
FIG. 4 is a partial perspective view of a torch and a cam according to the present invention.
Figure 5:
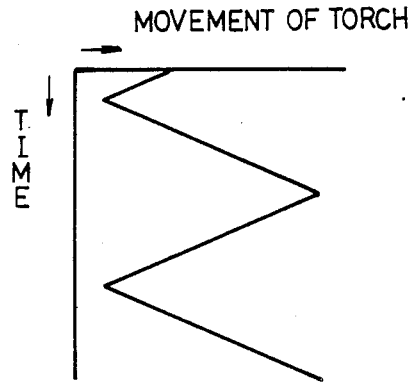
FIG. 5 is a graph which illustrates the relationship between a movement of a torch and time, according to the present invention.
Figure 6:
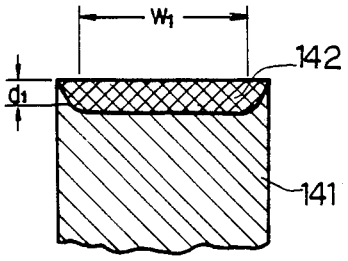
FIG. 6 is an enlarged cross-sectional view of a cam on which a method and apparatus according to the present invention was applied.

As shown in FIG. 4, when the motor 132 rotates the camshaft 14 about an axis thereof and the motor 42 drives the holder 13 in the horizontal direction in FIG. 1, a trail 161 of a high energy emitted from the torch 16 is formed on the cam surface of the camshaft 14. The width of the trail 161 depends on the horizontal length of the movement of the holder 13, and the trail 161 forms a zig-zag pattern which includes a plurality of folded portions and a plurality of straight lines, as shown in FIG. 5. Further, the torch 16 emits a high energy such as a laser, an electron beam or tungsten inert gas (TIG) arc, and melts a cam surface of the cam 141 to form a chill layer thereon, and the camshaft 14 moves at a constant speed according to the rotation of the cylinder cam 421. Accordingly, as shown in FIG. 6, a chill layer of substantially equal depth is formed on the cam surface of the cam 141. For example, the width '$W_1$' of the cam 141 is 9 mm, and the depth '$d_1$' of the chill layer is 1.2 mm.

Figure 7:
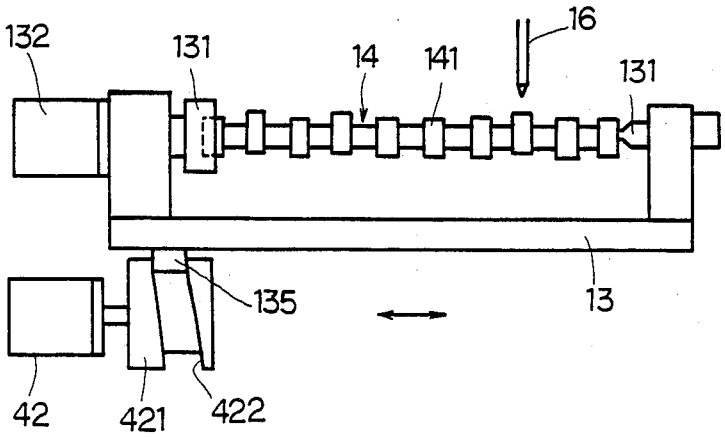
FIG. 7 is a side view of a second embodment of the present invention.

FIG. 7 shows a side view of a second embodiment according to the present invention. This second embodiment is substantially similar to the first embodiment disclosed above. However, a guide portion 135 of a holder 13 is directly inserted into a peripheral guide groove 422 of the cylinder cam 421. This second embodiment does not necessitate a rod to transfer the rotational movement of the cylinder cam 421 to the holder 13. The guide portion 135 projects downwardly from the lower surface of the holder 13 and the guide portion 135 is inserted into a top portion of the peripheral guide groove 422 of the cylinder cam 421. The two motors 132 and 42 are located in the same vertical line.

Figure 8:
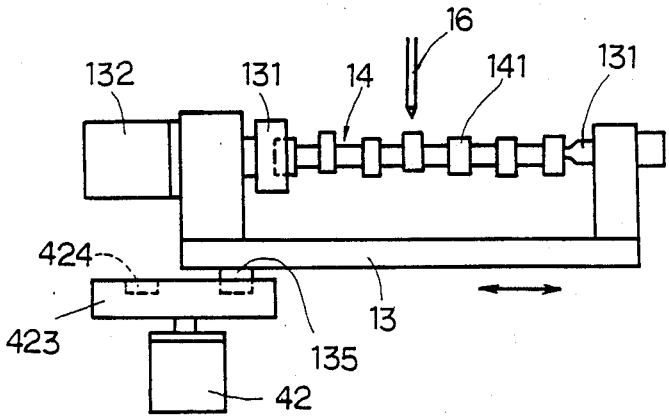
FIG. 8 is a side view of a third embodiment of the present invention.

FIG. 8 shows a side view of a third embodiment according to the present invention. This third embodiment is substantially similar to the second embodiment disclosed above.

Figure 9:
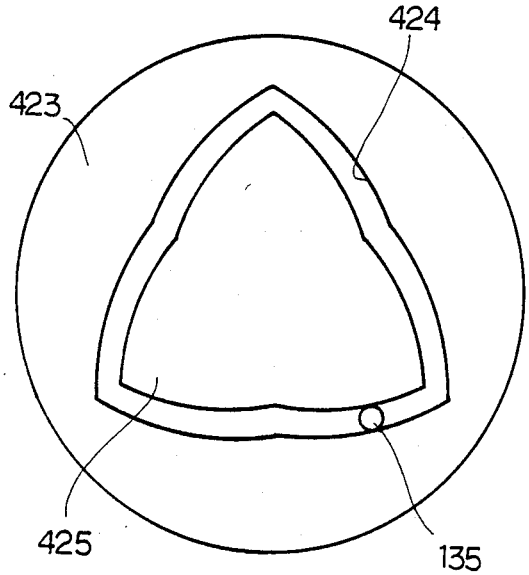
FIG. 9 is a top view of a cam plate employed in the third embodiment.
Figure 10:
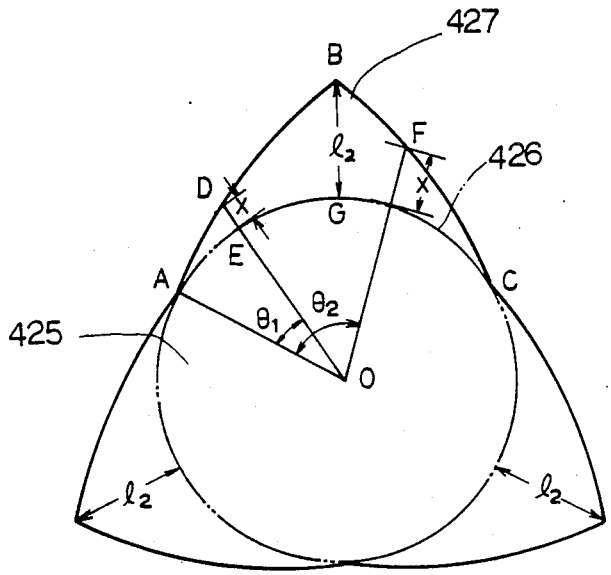
FIG. 10 is an enlarged view which illustrates a shape of an inner portion of the cam plate employed in the third embodiment of the present invention.

The third embodiment includes a cam plate 423 instead of the cylinder cam 421 of the second embodiment. As shown in FIG. 9, the cam plate 423 includes a guide groove 424 formed in an upper surface of the cam plate 423, and a guide portion 135 of a holder 13 is directly inserted into the guide groove 424. When the cam plate 423 is rotated by a motor 42 in the horizontal plane, the holder 13 is moved in the axial direction of the camshaft 14. FIG. 10 shows the shape of an inner portion 425 of the cam plate 423. The guide groove 424 is located along the inner portion 425 of the cam plate 423, and has a constant width in the cam plate 423. The shape of the inner portion 425 of the cam plate 423 comprises a basic circle 426 and three lift portions 427, each of which has substantially an isosceles triangle shape.

A peripheral shape defined 'A' through 'B' in FIG. 10 is calculated by a first formula (1) as follows:

$$x = l_2 \cdot \theta_1 / 60 \quad (1)$$

wherein, 'x' is a radial length defined between a peripheral point 'D' of the lift portion 427 and a peripheral point 'E' of the basic circle 426, '$\theta_1$' is an angle defined between a line $\overline{AO}$ and a line $\overline{DO}$ and '$l_2$' is a radial length defined between the most outer point 'B' of the lift portion 427 and a peripheral point 'G' of the basic circle 426.

A peripheral shape defined 'B' through 'C' in FIG. 10 is calculated by a second formula (2) as follows:

$$x = l_2 \cdot (120 - \theta_2) / 60 \quad (2)$$

wherein '$\theta_2$' is an angle defined between a line $\overline{AO}$ and a line $\overline{FO}$.

Accordingly, when the cam plate 423 has made a full turn, the holder 13 has moved back and forth three times in the axial direction of the camshaft 14 and the axial length of the movement is the same as the radial length '$l_2$' of the lift portion 427.

When the holder 13 is moved in the axial direction of the camshaft 14 by the cam plate 423, the holder 13 is moved at a constant speed and an emitted trail of a high energy on a cam surface of a cam 141 becomes a zig-zag pattern which is the same as the zig-zag pattern of the first embodiment disclosed above.

Figure 11:
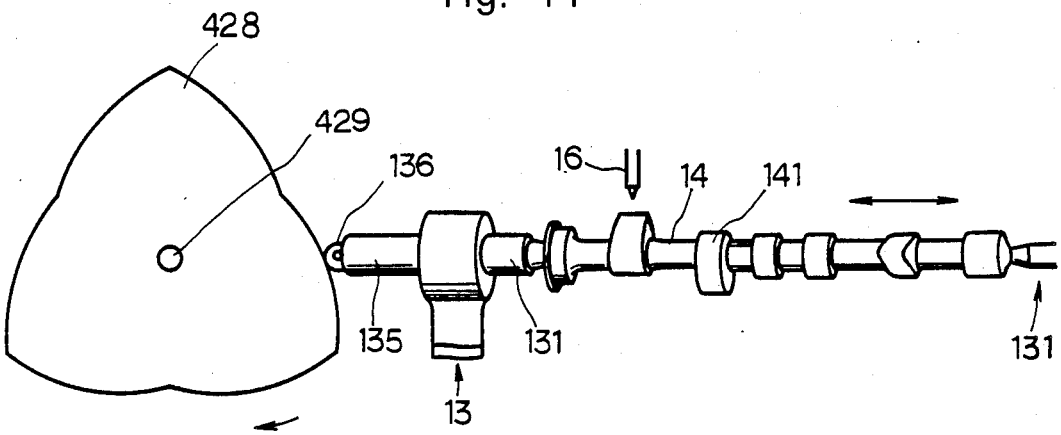
FIG. 11 is a partial perspective view of a fourth embodiment of the present invention.

FIG. 11 illustrated a partial perspective view of a fourth embodiment according to the present invention. This fourth embodiment is substantially similar to the third embodiment disclosed above. However, the fourth embodiment includes a cam plate 428 and a guide portion 135 of a holder 13. The outer space of the cam plate 428 is the same as the peripheral shape of the inner portion 425 of the cam plate 423 of the third embodiment. The guide portion 135 projects in the horizontal direction from the holder 13 and includes a roller 136 on an end thereof. When the cam plate 428 rotates about an axis 429, the roller 136 is in contact with and moves on a peripheral edge of the cam plate 428. The axis 429 of the cam plate 428 is located in a horizontally extending position from the axial direction of the camshaft 14. Accordingly, the holder 13 moves at a constant speed in the axial direction of a camshaft 14.

Figure 12:
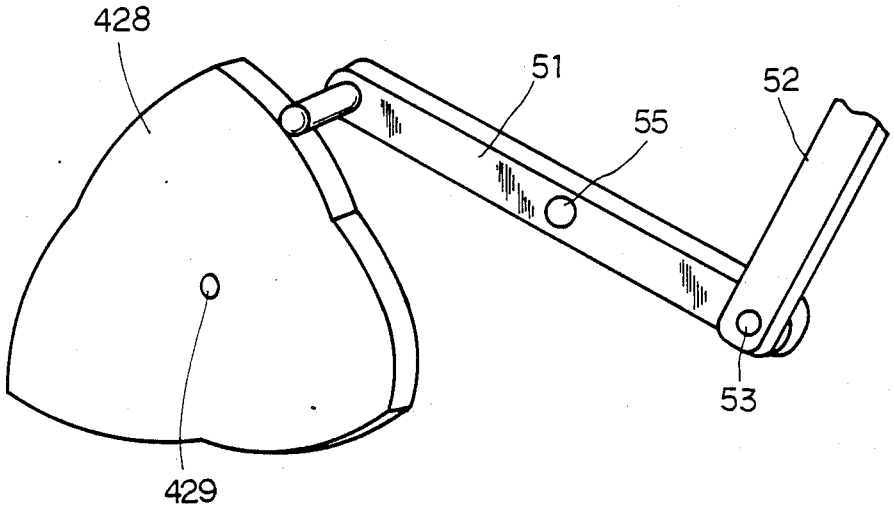
FIG. 12 is a partial perspective view of a fifth embodiment of the present invention.
Figure 13:
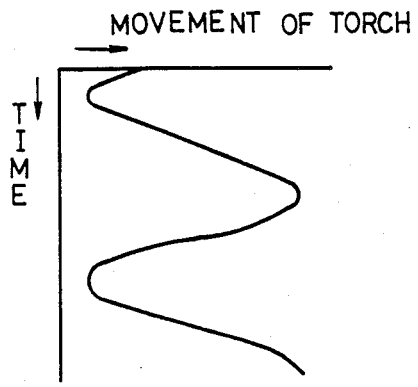
Fig. 13 PRIOR ART
FIG. 13 is a graph which illustrates the relationship between the movement of a torch and time, according to a prior art approach which employs an eccentric cam mechanism.
Figure 14:
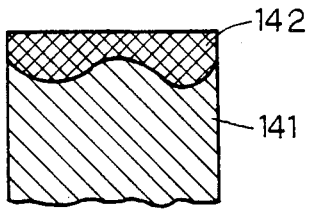
Fig. 14 PRIOR ART
FIG. 14 is a partial enlarged cross-sectional view of a cam on which a method according to a prior art approach has been applied.

FIG. 12 illustrates a partial side view of a fifth embodiment according to the present invention. This embodiment is substantially similar to the fourth embodiment disclosed above. However, the fifth embodiment includes a link mechanism which transfers the rotational movement of a cam plate 428 to the horizontal movement of a holder (not shown in FIG. 12). The link mechanism includes a first link 51 and a second link 52. The first link 51 is rotatably mounted on a base member (not shown in FIG. 12) by a pin 55 and an end of the first line 51 includes a roller 54 which is in contact with a peripheral edge of the cam plate 428. Another end of the first link 51 is rotatably connected to an end of the second link 52 by another pin 53 and another end of the second link 52 is rotatably connected to a holder (not shown in FIG. 12). Accordingly, when the cam plate 428 rotates about an axis 429, the first link 51 swings about the pin 55 and the second link 52 swings. As a result, the holder is moved in the axial direction of the camshaft 14. The shape of the cam plate 428 is the same as the shape of the cam plate of the fourth embodiment so that the holder is moved at a constant speed in the axial direction of the camshaft 14. The other end of to second link 52 is connected to a torch.

Accordingly, when the torch is moved at a constant speed in the axial direction of the camshaft 14 by the cam plate 428 and the link mechanism and camshaft 14 rotate about an axis thereof, a trail emitted from the torch becomes a zig-zag pattern which is the same as the zig-zag pattern of the emitted trail of the first embodiment according to the present invention.

While the present invention has been described in its preferred embodiments, it is to be understood that the invention is not limited thereto, and may be otherwise embodied within the scope of the following claims.

What is claimed is:

1. A method for hardening a surface of a cam secured to a camshaft comprising the steps of:

rotating a cylinder cam which has a continuous peripheral guide groove, said continuous peripheral guide groove comprising at least two straight grooves and at least two 'V' shape connecting portions so that said at leat two 'V' shape connecting portions connect said at least two straight groove and form said continuous peripheral guide groove on an outer peripheral surface of said cylinder cam;

swinging a rod member by said rotation of said cylinder cam, a first end portion of said rod member being located in said continuous peripheral guide groove of said cylinder cam, an intermediate portion of said rod member being pivoted on a base member;

oscillating a holding means by said swing movement of said rod member, said camshaft being mounted on said holding means, said oscillation being at a constant speed in the axial direction of said camshaft, a second end portion of said rod member being connected to said holding means, said holding means including a vertical guide groove, said second end ortion of said rod member being inserted into said vertical guide groove;

rotating said camshaft in a circumferential direction of said camshaft concurrently with said oscillating, said rotating being performed by a second driving means;

emitting high energy from an emitting means concurrently with said oscillating and second rotating steps to a surface of a cam to be hardened to melt said surface of said cam; and vertically oscillating said emitting means in the vertical direction concurrently with said rotating of said camshaft, whereby said emitting means is always located over said cam with a constant interval defined between said surface of said cam and said emitting means, and whereby said camshaft is oscillated at said constant speed in the axial direction of said camshaft and said camshaft concurrently rotates in the circumferential direction of said cam during the emitting step so that a chill layer of constant depth along the axial direction of the camshaft is formed on the surface of the cam.

2. The method of claim 1, wherein said rod member includes a plurality of adjusting apertures and a pivot member which is inserted into one of said adjusting apertures whereby when said pivot member is inserted into different apertures of said plurality of adjusting apertures a width of said oscillation of said holding means is changed.

3. The method of claim 2, wherein an emitted trail on said surface of said cam is of a zig-zag pattern.

4. The method of claim 3, wherein said zig-zag pattern of said emitted trail on the surface of the cam comprises a plurality of straight portions connected by 'V' shape portions so as to form a continuous line.

5. A method for hardening a surface of a cam secured to a camshaft comprising the steps of:

rotating a cam plate which has a guide groove on an upper surface thereof, the guide groove being continuous and being formed along an inner portion of said cam plate, a shape of the inner portion of said cam plate comprising a basic circle and a plurality of lift portions, each lift portion being formed substantially in the shape of an isosceles triangle;

oscillating a holding means for holding the camshaft at a constant speed in the axial direction of the camshaft by the rotation of said cam plate, said holding means including a projection which is inserted into said peripheral guide groove of said cam plate;

rotating the camshaft in the circumferential direction of the camshaft concurrently with said oscillating; and emitting high energy from an emitting means to the surface of the cam to melt the surface of the cam concurrently with said oscillating and second rotating steps, whereby said camshaft is oscillated at the constant speed in the axial direction of the camshaft while said camshaft is also rotated in the circumferential direction of said cam during said emitting step so that a chill layer of constant depth is formed on the surface of the cam.

6. The method of claim 5, wherein each of said plurality of lift portions of said inner portion of said cam plate has a top point and two rounded side surfaces.

7. A method for hardening a surface of a cam secured to a camshaft comprising the steps of:

rotating a cam plate which has an outer peripheral edge, said cam plate comprising a basic circle with a plurality of lift portions, each lift portion being in the general shape of an isosceles triangle;

oscillating a hold means for holding said camshaft at a constant speed in the axial direction of the camshaft by the rotation of said cam plate, said holding means including a projection which is in contact with the outer peripheral edge of said cam plate;

rotating said camshaft in a circumferential direction of the camshaft concurrently with said oscillating; and emitting high energy from an emitting means to the surface of said cam to melt said surface of the cam concurrently with said oscillating and rotating, whereby said camshaft is oscillated at the constant speed in the axial direction of the camshaft while said camshaft is also rotated in the circumferential direction of said cam during said emitting step so that a chill layer of constant depth is formed on the surface of the cam.

8. The method of claim 7, wherein an outer peripheral edge of said lift portion has a top point and two rounded side surfaces.

9. A method for hardening a surface of a cam secured to a camshaft, comprising the steps of:

rotating a cam plate which has an outer peripheral edge, said cam plate comprising a basic circle and a plurality of lift portions, each of said plurality of lift portions being formed in the general shape of an isosceles triangle;

oscillating a holding means for holding the camshaft at a constant speed in the axial direction of the camshaft by the rotation of said cam plate, said holding means including a link mechanism, a first end of link mechanism being in contact with the outer peripheral edge of said cam plate, a second end of said link mechanism being connected to said holding means;

rotating said camshaft in a circumferential direction of said camshaft concurrently with said oscillating; and emitting high energy from an emitting means to said surface of said cam to melt said surface concurrently with said oscillating and rotating, whereby said camshaft is oscillated at said constant speed in said axial direction of said camshaft while said camshaft is also rotated in the circumferential direction of said camshaft during said emitting step so that a chill layer of constant depth along in the axial direction of the camshaft is formed on the surface of the cam.

10. The method of claim 9, wherein said outer peripheral edge of each triangle formed on each said lift portion of cam plate has a top point and two rounded side surfaces.

* * * * *